United States Patent [19]

Graham et al.

[11] Patent Number: 4,797,662

[45] Date of Patent: Jan. 10, 1989

[54] WIRE PREBREAK/BREAK DETECTOR

[75] Inventors: Randall C. Graham, Nashville; Jeffrey S. Smith, Franklin, both of Tenn.

[73] Assignee: Essex Group, Inc., Fort Wayne, Ind.

[21] Appl. No.: 101,231

[22] Filed: Sep. 25, 1987

[51] Int. Cl.[4] ..... G08B 21/00

[52] U.S. Cl. ..... 340/677; 72/17; 340/679; 340/686

[58] Field of Search ..... 340/677, 679, 686; 72/4, 17, 253.1

[56] References Cited

U.S. PATENT DOCUMENTS

| | | | |
|---|---|---|---|
| 3,226,702 | 12/1965 | Zawels | 340/677 |
| 3,667,509 | 6/1972 | Rohrbacher | 72/17 |
| 4,695,830 | 9/1987 | Graham | 340/677 |

*Primary Examiner*—Glen R. Swann, III

*Attorney, Agent, or Firm*—Francis J. Maguire, Jr.

[57] ABSTRACT

A wire prebreak/break sensor is disclosed for use in a low cost verbal annunciator system for use in monitoring a wire fabrication process. Wire exiting a drawing machine is accumulated and has its tension controlled by a dancer arm. According to the present invention, a wire accumulator having a plurality of channels is used as a wire prebreak/break sensor. The accumulator comprises a plurality of rods having sheaves on a end of each supported on a support structure to which each rod is pivoted on an axis. A plurality of position sensors are responsive to the positions of the various rods and provide a position signal having a magnitude indicative thereof. An operator input device is responsive to operator initiated input action for providing input signals indicative of wire gauge. A signal processor is responsive to the position signals and to the operator input signals and retrieves a pair of boundary signals in response to the magnitude of the gauge size input signals. The magnitudes of the boundary signals will vary depending on the gauge selected. The signal processor compares the magnitudes of the position signals to the boundary signals and provides an alarm signal whenever one of the position signal magnitudes is greater or less than the magnitudes of both of the boundary signals. The signal indicating a broken wire is provided to the verbal annunciator so that immediate corrective action may be taken by maintenance personnel.

1 Claim, 2 Drawing Sheets

WIRE PREBREAK/BREAK DETECTOR

BACKGROUND OF THE INVENTION

This invention relates to process alarm systems and, more particularly, to a detector for a verbal annunciator in a wire fabrication process.

Modern wire manufacturing processes often require fast response and quick corrective action to prevent production delays. For example, recently developed high speed wire manufacturing processes in which a heavy gauge wire is drawn down to a smaller size, e.g., #12 AWG to #22 AWG, can experience faults which, if not rapidly corrected, can cause expensive production shutdowns. Factories for making such wire may consist of a large number of such production units spread over a wide expanse and staffed only by a small number of maintenance personnel on an around the clock basis. Unfortunately, present alarming systems for detecting faults and producing audio and visual alarms are sometimes inadequate in providing sufficient information to immediately direct the maintenance personnel to the source of the problem in time to prevent production shutdowns.

Copending application Ser. No 788,990 entitled, LOW COST VERBAL ANNUNCIATOR, discloses, but does not independently claim a number of unique sensors for detecting abnormal conditions in a wire fabrication process. One of those disclosed sensors is a wire break sensor which was claimed in an application filed with said copending application but since abandoned. That invention has been improved upon and is claimed herein.

SUMMARY OF THE INVENTION

The object of the present invention is to provide a wire prebreak/break sensor for use with a verbal annunciator which provides an immediate verbal announcement pinpointing the source of a fault to one of a plurality of possible sources including a wire prebreak/break. Immediate corrective action may then be taken to prevent production shutdowns or for trouble shooting purposes.

According to the present invention, a wire fabrication process alarm system is responsive to a plurality of sensors including a wire prebreak/break detector which provides a discrete signal (hereinafter may simply be referred to as "discrete" meaning a binary, two-state, or on-off type signal) indicative of either a continuous or broken (or about to be broken) wire. A prebreak/break detector comprises, among other elements, a plurality of dancer arm position sensors for providing a corresponding plurality of dancer arm position signals and a signal processor responsive thereto. The signal processor is also responsive to an operator interface unit, which also forms one of the elements of the prebreak/-break detector, and which includes a keyboard and which may include a display. The keyboard provides operator input signals to the signal processor and the processor provides output signals to the display. The operator input signals includes wire gauge input information which is used by the processor for alarm and display purposes, among others.

In response to each operator input signals, the signal processor retrieves a pair of boundary signals indicative of the acceptable height of dancer arms within a height window having upper and lower bounds defined by the two boundary signal magnitudes. It then determines whether all of the sensed dancer arm position signals are within the window and, if not, provides an alarm discrete.

In further accord with the present invention, a central monitoring unit having a plurality of cassette tape players, each responsive to one of the alarm output discrete signals from the signal processor, provides individualized verbal message signals in response to the presence of a two-state (binary) signal in a state indicative of an abnormal process condition. One of the cassette tape players contains a message for announcing a break in a wire and is responsive to the wire prebreak/break discrete provided by the processor. A public announcement (PA) system is responsive to the individualized verbal message signals from each of the cassette players for announcing individualized verbal messages to maintenance personnel for quick action.

These and other objects, features and advantages of the present invention will become more apparent in light of the following detailed description of a best mode embodiment thereof, as illustrated in the accompanying drawing.

BEST MODE FOR CARRYING OUT THE INVENTION

Figure 1:
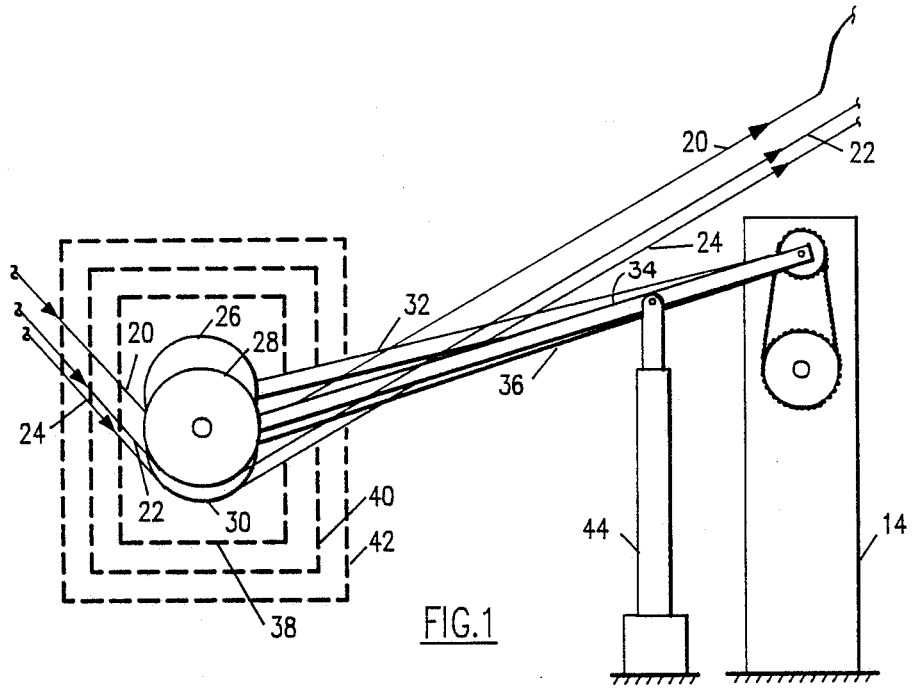
FIG. 1 is an illustration of a plurality of dancer arms which form part of a prebreak/break detector, according to the present invention.

FIG. 1 illustrates part of a wire fabrication process in which drawn wires 20, 22, . . . 24 exit a drawing machine and, before being annealed, are respectively fed to sheaves 26, 28, . . . 30 attached to independently pivoted dancer arms 32, 34, . . . 36, which are used as wire accumulators and also used to maintain the correct tension. The dancer arms shown in FIG. 1 are attached for pivoting to one or more pedestals 14, only one of which is shown. At the other end of each arm is a sheave for engaging a wire. If a wire breaks, the associated arm will fall down outside dashed boxes 38, 40, 42 which are indicative of positional windows within which the dancer arms must stay to maintain acceptable heights. Only one box need be in effect at any one time. The sizes of the windows change according to the gauge of the wire being drawn due to the different drawing speeds for different sizes of wire.

A wire break may occur, for example, if a die bar in the enameling oven (downstream of the dancer arms) becomes snagged with a jammed wire so that the pulling capstan can no longer pull additional wire being accumulated by the associated dancer arm. In that case, the associated dancer arm will fall out of the window box 38, 40, . . . or 42, whichever happens to be the window box which is invoked for the type of wire being drawn. The falling out will occur from inside the box in a downward direction so that the lower boundary of the window box is violated.

Another type of situation, known as a prebreak situation, occurs, for example, when a voltage dip occurs in the voltage for driving the wire drawing machine, which supplies the wires to the dancer arms. In such a case, since the drawing machines are normally supplied from the utility grid and since the capstan pulling the wires out of the dancer arm accumulator is powered with a well regulated in-house generator, if a voltage dip occurs in the grid, the drawing machine motors will slowdown and the capstan motor will not. Thus, the wire accumulated in the dancer arm accumulators will start to be used up. In that case, if the voltage dip lasts long enough, the dancer arm will exit the window box from the top first before th wire breaks since the dancer arms will go in an upward motion until the tension provided by a bank of air pistons (only one 44 of which is shown attached to dancer arm 34) pulling down on the dancer arms is too great for the wire being pulled by the capstan to overcome. At that point the wire will break and the dancer arm will fall back into the window box and immediately out again through the bottom. As soon as the dancer arm exits the box from the top an alarm output discrete can be provided indicating a prebreak condition or even simply annunciating the condition as a wire break condition to give maintenance personnel more time.

Figure 2:
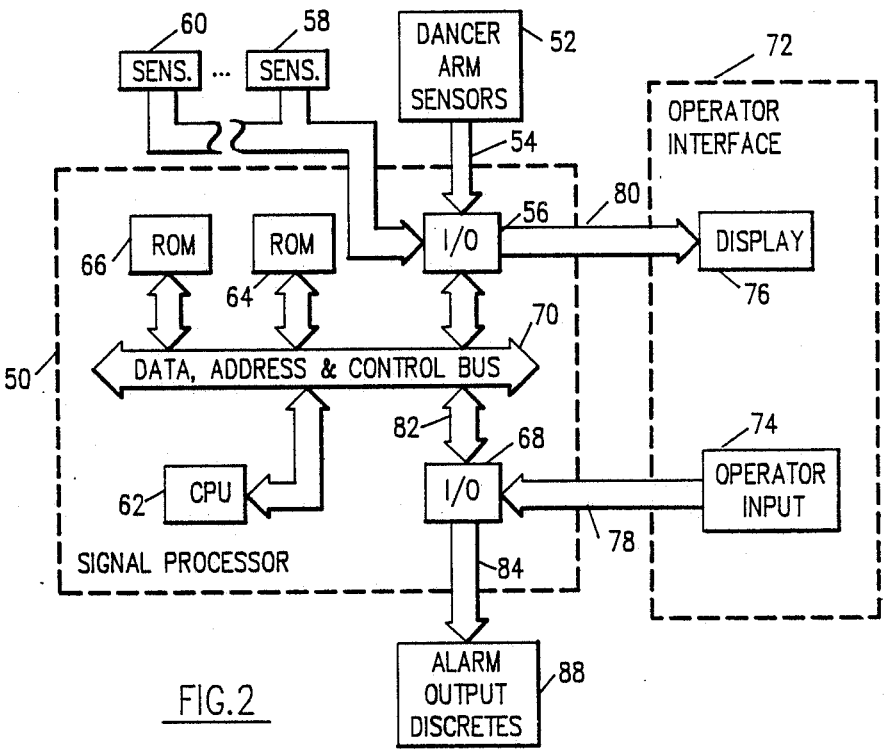
FIG. 2 is an illustration of a signal processor also forming part of a prebreak/break detector for use with the dancer arms of FIG. 1.

FIG. 2 shows a signal processor 50 responsive to a plurality of dancer arm height sensors 52 which provide height signals on a plurality of lines 54 to an input/output (I/O) port 56 of the processor 50. The I/O port is also responsive to a plurality of different types of sensors 58, . . . 60 which may, for example, be wire tangle sensors, wire runtogether sensors, etc.

The I/O to port 56 may include analog/digital converters for converting the analog dancer arm height signals to a digital format for use in the signal processor.

The signal processor may have an architecture which has a central processing unit (CPU) 62, a random access memory (RAM) 64, a read only memory (ROM) 66, another I/O port 68, and a data, address and control bus 70.

The signal processor interfaces with an operator interface unit 72, which has an operator input unit 74 which may be a keyboard or a number of switches, and a display 76 for displaying screens, data and input values. The operator input signals are provided on a line 78 to the I/O port 68 while the I/O port 56 provides display signals on a line 80 to the display 76. The operator input signals on line 78 are routed via a plurality of signal lines 82 to the bus 70 via which the operator input signals are stored in RAM 64. The operator input signals are used for various purposes by the signal processor including control of the drawing machine speed, etc., but which purposes do not form the substance of the present invention and which will therefore not be described in detail.

The signal processor 50 provides a wire break alarm output discrete on one or more of a plurality of lines 84 in response to one or more of the dancer arms exiting the applicable height window whether it be window 38, 40 or 42 which is in service. The signal processor is capable of providing any number of different types of alarm output discretes as initiated by conditions related to the dancer arm sensors 52, or any of the other sensors 58, . . . 60 with which it interfaces. The output alarm discretes are symbolized by a block 88 which signifies an on/off type binary signal indicating either the presence or absence of an alarm condition.

Figure 3:
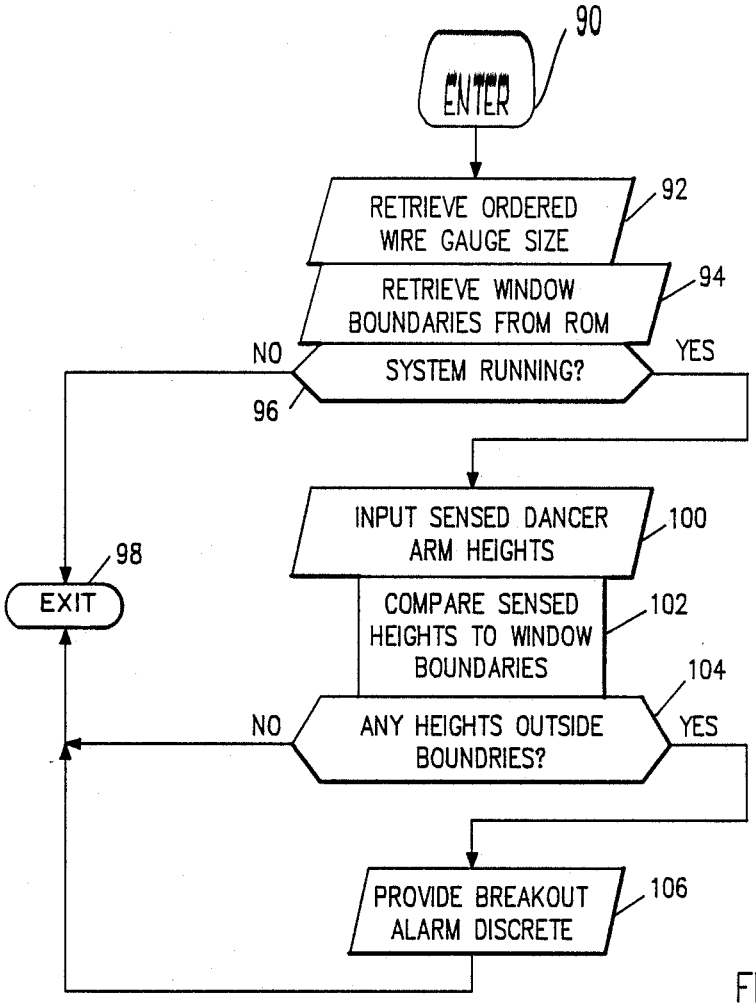
FIG. 3 is a flowchart illustration of a number of logical steps which may be carried out on the signal processor of FIG. 2.

Referring now to FIG. 3, a flowchart illustration is there shown of a number of logical steps which may be executed by the signal processor 50 of FIG. 2 and which may be stored in the ROM 66 thereof for repetitive execution. The first step is an entry step 90 after which the ordered wire gauge size is retrieved in a step 92 from RAM 64 within the signal processor 50. This information will have already been entered by the operator via the operator interface 72 using the operator input device 74. A step 94 is next executed in which the window boundaries corresponding to the selected wire gauge size are retrieved from ROM. A determination is next made in a step 96 as to whether or not the system is running. If not, an exit is made in a step 98. If so, the dancer arm heights are determined from the magnitudes of the sensed signals provided by the dancer arm sensors 52 on lines 54. A step 102 is next executed in which the magnitudes of the sensed height signals are compared to the magnitudes of the window boundaries. If any of the heights are outside of the boundaries, as indicated by the comparison and as determined in a step 104, a break out alarm discrete is provided on line 84 of FIG. 1 as indicated by a step 106 in FIG. 3. If not outside the boundaries of the window, an exit is made in step 98.

Figure 4:
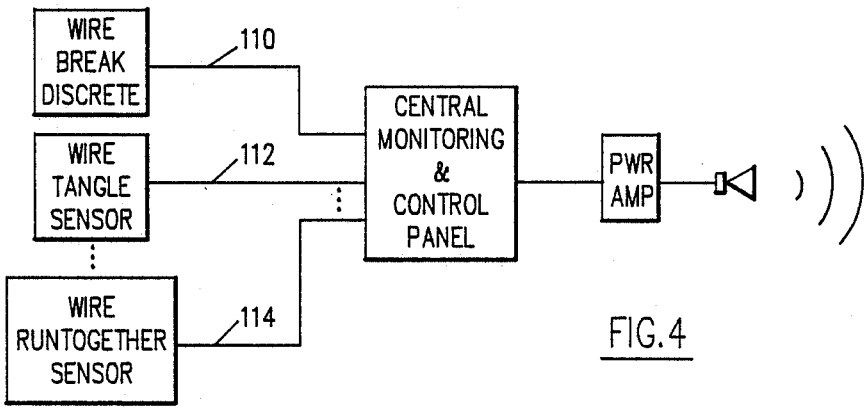
FIG. 4 is an illustration of a central monitoring and control panel which may include the signal processor and operator interface of FIG. 2 for sensing wire production problems, including a wire prebreak/break, and for announcing the nature of the sensed problem verbally.

Signals on lines 110, 112, . . . 114 from a wire break discrete and similar signals from e.g., a wire tangle sensor and a wire runtogether sensor are provided to a combined central monitoring and control panel shown in FIG. 4, as disclosed in copending application Ser. No. 788,990 entitled, LOW COST VERBAL ANNUNCIATOR, which in turn provides an alarm message signal for verbal annunciation through a power amplifier and speaker to maintenance personnel for quick corrective action. (The signal processor 50 and operator interface of FIG. 2 may be thought of as equivalent to the central monitoring and control panel of FIG. 4). If the maintenance personnel can get to the broken wire in time, a fix may be made fast enough to prevent an extended shutdown Thus, although FIG. 4 is an illustration of a central monitoring and control panel for use in a low cost verbal annunciator as disclosed in copending application Ser. No. 788,990, the central panel may be thought of as equivalent to the combined signal processor 50 and operator interface 72 and the contents of the control panel of that application as well is responsive to the plurality of sensors 52, 58, . . . 60 for sensing abnormal conditions in a wire fabrication process. These may include the dancer arm sensors 52, according to the present invention. They also may include a wire tangle sensor and a wire runtogether sensor, among others. Each of these sensors provide binary states one of which states indicates normal operating conditions while the other indicates an abnormal condition which triggers an associated cassette tape player within the central panel. The cassette player provides an output message signal to a power amplifier which amplifies the message signal and provides an amplified message signal for acoustic annunciation on a speaker. Maintenance personnel within the hearing of the announced message will immediately be alerted to the source o the problem so that fast corrective action can be taken before a serious production delay occurs.

Although the invention has been shown and described with respect to a best mode embodiment thereof, it should be understood by those skilled in the art that the foregoing and various other changes, omissions, and additions in the form and detail thereof maybe made therein without departing from the spirit and scope of the invention.

We claim:

1. A wire break sensor, comprising:

a plurality of rods having sheaves on an end of each;

a support structure for supporting an other end of each rod and for pivoting each supported end on an axis;

a plurality of sensors, each responsive to the position of a corresponding one of said plurality of rods for providing a position signal having a magnitude indicative thereof;

an operator input device, responsive to operator initiated inputs for providing input signals indicative of wire gauge; and a signal processor, responsive to said position signals and to said input signal, for retrieving a pair of boundar signals in response to said input signals for comparing the magnitudes of said position signals to said boundary signals and for providing an alarm signal whenever any one of said position signal magnitudes is greater or less than the magnitudes of both of said pair of boundary signals.

* * * * *